United States Patent [19]

Miskin

[11] Patent Number: 4,553,608

[45] Date of Patent: Nov. 19, 1985

[54] SCRAPER WITH RIPPER ASSEMBLY

[76] Inventor: Richard B. Miskin, P.O. Box 218, Ucon, Id. 83454

[21] Appl. No.: 580,678

[22] Filed: Feb. 16, 1984

[51] Int. Cl.[4] ..... A01B 49/02; E02F 3/85

[52] U.S. Cl. ..... 172/197; 172/785; 172/464

[58] Field of Search ..... 172/197, 198, 785, 464, 172/812, 827, 491, 413, 200

[56] References Cited

U.S. PATENT DOCUMENTS

| | | | |
|---|---|---|---|
| 2,840,933 | 7/1958 | Brem | 172/197 X |
| 3,319,366 | 5/1967 | Thompson | 172/785 X |
| 3,324,955 | 6/1967 | Perold | 172/197 X |
| 3,724,557 | 4/1973 | Boschung | 172/197 |
| 3,774,696 | 11/1973 | Horsch | 172/812 |
| 3,941,195 | 3/1976 | Stedman | 172/827 |
| 4,383,380 | 5/1983 | Miskin | 37/129 |

FOREIGN PATENT DOCUMENTS

| | | | |
|---|---|---|---|
| 232032 | 2/1964 | Austria | 172/197 |
| 1074994 | 4/1980 | Canada | 172/197 |

*Primary Examiner*—Richard J. Johnson

[57] ABSTRACT

A scraper machine for ground levelling and earth planing having a scraper unit and a ripper assembly for scarifying and loosening in advance of levelling and planing and with the ripper assembly being carried by a raised front end member of the scraper unit, vertically adjustable with respect to the scraper unit, and pulled through a ripper tongue that is pivotally connected to a main tongue of the scraper unit.

1 Claim, 4 Drawing Figures

SCRAPER WITH RIPPER ASSEMBLY

BACKGROUND OF THE INVENTION

1. Field of the Invention

This invention relates to scraper for ground levelling and earth planing and is particularly concerned with scrapers having a ripper assembly thereon to scarify and loosen soil in advance of the levelling and planing performed with such apparatus.

2. State of the Art

Scrapers and earth movers of the general type to which the present invention pertains are well known.

My U.S. Pat. No's. 4,383,380 and 4,398,363, for example, show scrapers of the type which we are presently concerned, but not including a ripper assembly.

U.S. Pat. No's. 2,984,026 and 2,745,328 disclose scraper machines having ripper assemblies connecting to draft arms. The ripper assemblies do not move in correlation with the scraper and the teeth of the ripper do not scarify or loosen soil ahead of a scraper blade to a uniform depth below the blade.

U.S. Pat. No's. 3,430,703, 4,015,348, and 4,393,608 show wheeled scraper and land levelling machines having scraper units with ripper assemblies carried by and vertically movable with the scraper units. Various structures are used to mount the ripper assemblies to the scraper units and to provide for positioning of teeth of the ripper assemblies relative to a cutting edge of the scraper unit. The ripper assembly of the machines shown in these patents are all mounted beneath the tongue connection of the scraper machine and the teeth of the ripper assemblies are thus subjected to substantial, potentially destructive torque forces as the teeth are pulled through the ground. The torque force is actually increased as the teeth are positioned to extend further beneath, the cutting edge of the scraper machine.

SUMMARY OF THE INVENTION

Objects of the Invention

Principal objects of the present invention are to provide a scraper machine having a scraper unit, a ripper assembly carried by the scraper unit and means for applying a pulling force directly to the ripper assembly to thereby minimize torque forces acting on the teeth of the ripper assembly during use of the scraper machine for land planing and levelling.

Other objects are to provide a scraper machine having means to vertically adjust the position of the teeth of a ripper assembly relative to the cutting edge of a cooperating scraper unit and to provide means for maintaining proper angular positioning of a ripper assembly relative to the cutting edge of the scraper during turning movements of the machine while planing and levelling land.

Features of the Invention

Principal features of the invention include a ripper assembly comprising a support bar and ripper teeth extending downwardly from the support bar and spaced therealong. The support bar is positioned between side members of the scraper unit and forwardly of the cutting edge or blade of the scraper unit.

A hydraulic circuit including hydraulic cylinders, connected between a top rail of the scraper unit and the support bar of the ripper assembly provides for vertical positioning of the ripper assembly relative to the cutting edge of the scraper unit.

A main tongue is rigidly connected to the center of the top rail and extends therefrom to an end having means thereon to permit coupling of the tongue to a towing vehicle or prime mover.

A ripper tongue is rigidly connected to the center of the support bar and extends therefrom to an end that is pivotally connected to a pin carried by the main tongue.

A guide arm is pivotally connected between the top rail and the support bar and maintains proper positioning of the ripper assembly relative to the cutting edge or blade of the scraper unit even during turning of the scraper machine as the machine is used for land levelling and planing.

Additional objects and features of the invention will become apparent from the following detailed description, taken together with the accompanying drawings showing a presently preferred embodiment of the invention.

THE DRAWINGS

In the drawings:

FIG. 1 is a side elevation view, of a scraper with ripper assembly of the invention and a prime mover therefore with parts broken away for clarity;

FIG. 2 a sectional view, taken on the line 2—2 of FIG. 1 and showing the ripper assembly in a raised position;

FIG. 3, a view like that of FIG. 2, but with ripper assembly in a lowered position; and FIG. 4. a schematic diagram of the hydraulic circuit of the invention.

DETAILED DESCRIPTION OF THE INVENTION

Figure 1:
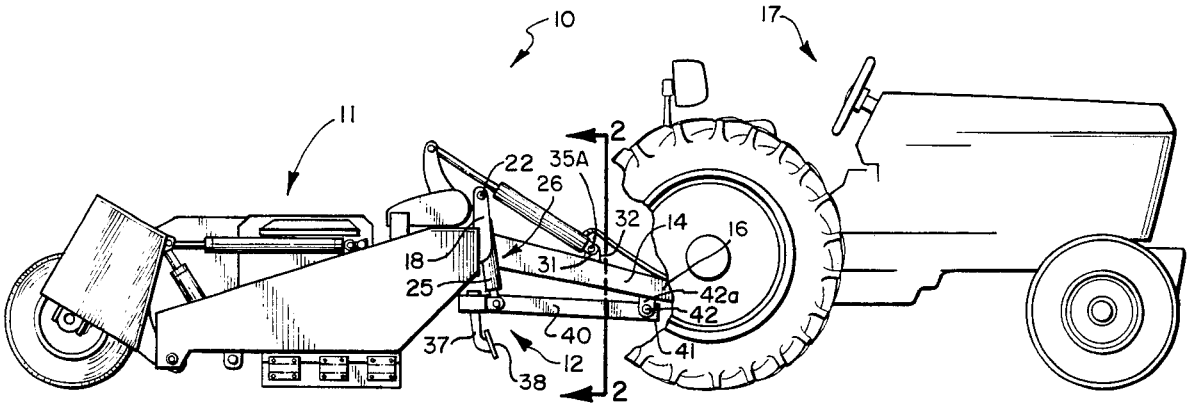
Figure 2:
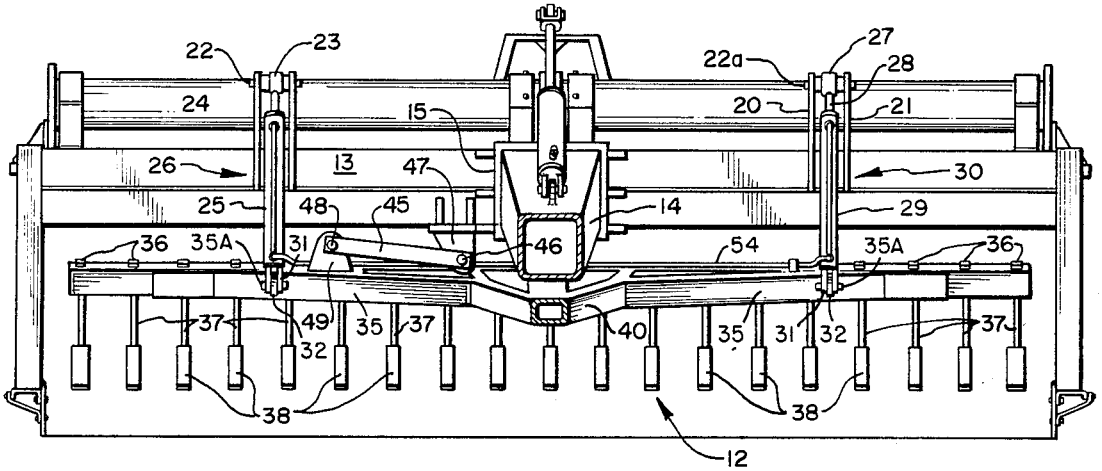
Figure 3:
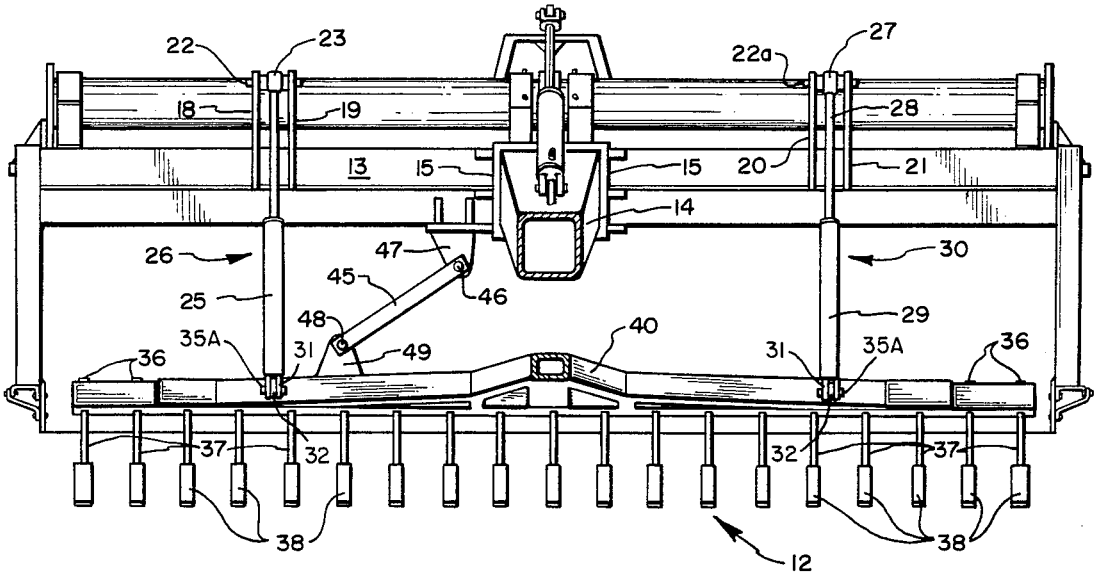

Referring now to the drawings:

In the illustrated preferred embodiment the scraper machine of the invention, shown generally at 10 includes a typical scraper unit 11 such as is shown in my aforementioned U.S. Pat. No's. 4,383,380, 4,388,769 and 4,398,363 and a ripper assembly shown generally at 12. Since the scraper unit is more fully described in my aforementioned patents only such components thereof as are necessary to an understanding of the present invention will be herein described in detail.

The scraper unit 11 includes a top rail 13 that extends substantially fully across the front of the scraper unit and a main tongue 14 that is rigidly attached at 15 to the front center of the top rail. Tongue 14 extends from top rail 13 to an end 16 that is adapted to be coupled to a prime mover 17 that may be a tractor or the like, in the manner disclosed in my U.S. Pat. No. 4,398,363, for example.

Pairs of spaced apart ears 18,19 and 20, 21 are fixed to and project upwardly from top rail 13 inwardly of the opposite ends of the top rail.

A pin 22 extends through the ears 18, 19 and a pin **22*a* extends through the ears 20 and 21. A ball joint 23 at the end of a cylinder rod 24 projecting from a hydraulic cylinder housing 25 of a master cylinder 26 is journalled on pin 22. Similarly a ball joint 27 at the end of a cylinder rod 28 projecting from a hydraulic cylinder housing 29 of a slave cylinder 30 is journalled on the pin 23. The rod 24 extends between the ears 18 and 19 and the housing 25 will fit between the ears 18 and 19 during reciprocation of the housing on the rod as will be further explained. Similarly, rod 28 extends between ears 20** and 21 and housing 29 will also fit between the ears 20 and 21.

The housings 25 and 29 of the master and slave cylinders each have a clevis 31 at the end thereof opposite the rods and the clevis straddles an ear 32 fixed to a support bar 35 of the ripper assembly 12. A pin 35*a* through each clevis 31 and ear 32, pivotally attaches the housings 25 and 29 to the support bar 35.

A series of teeth 36 are spaced along and project downwardly from the support bar 35 to loosen earth that is to be levelled or planed by the. Each tooth 36 has a support shaft 37 that is welded or otherwise affixed to the support bar and a cutting face 38 that is angled forwardly from the support shaft.

A tongue 40, welded or otherwise rigidly attached to support bar 35, projects therefrom to terminate in an end 41 that is pivotally connected to the tongue 14 adjacent to its end adapted to be coupled to the prime mover 17. A pin 42, inserted through spaced ears 42*a* projecting downwardly from tongue 14, connects the tongue 40 to the tongue 14 such the tongue 40 can pivot up and down with respect to tongue 14 and will permit some lateral movement of tongue 40 relative to tongue 14, as well.

A guide arm 45 is pivotally connected at one of its ends by a pivot pin 46 to an ear 47 projecting downwardly from the top rail 13. A pivot pin 48 connects the other end of the guide arm 45 to an ear 49 projectingg upwardly from the support bar 35. The guide arm 45 extends substantially transverse to the direction of travel of the scraper unit and prevents wandering of the ripper assembly 12 when the ripper assembly is ripping in a curve.

Figure 4:
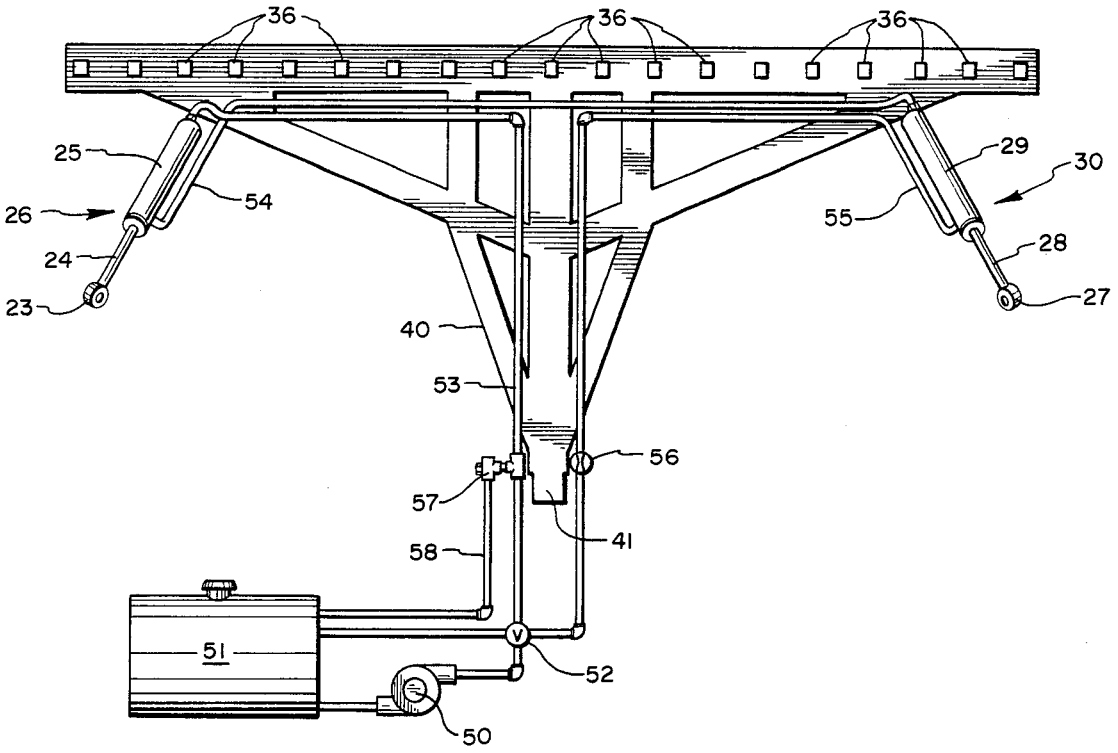

In use, the master cylinder 26 and slave cylinder 30 are coupled into a hydraulic system, including a pump 50 and hydraulic reservoir 51 of the prime mover 17. As shown in FIG. 4, a control valve 52 is manipulated by the operator of the prime mover to direct fluid from pump 50 into a line 53 and into the end of housing 25 opposite rod 24. The fluid moving into cylinder 26 through line 53 moves housing 26 along rod 24 (rod 24 being fixed to top rail 13) and forces fluid from the other end of cylinder 26 through line 54. Fluid forced into line 54 is moved into the end of slave cylinder 30 opposite to rod 27 and moves housing 29 along rod 28 at the same time fluid in the other end of cylinder 30 is discharged through line 55, restrictor 56 and valve 52 back into reservoir 51. The restrictor 56 limits the flow through line 55 and consequently, the speed at which the ripper unit is moved. As the housings 25 and 29 are moved the ripper unit 12 is forced downwardly, pivoting about pin 42 and guided by arm 45. When the ripper unit is in a desired position relative to the scraper unit, the operator manipulates valve 52 to cut off flow from pump 50 into line 53 and to direct flow from the pump directly back into reservoir 51. Control valve 52 is manipulated to direct flow from pump 50 through restrictor 56 and into line 55 and the upper end of slave cylinder 30 when the ripper unit 12 is to be raised with respect to the scraper unit. Fluid is then discharged from cylinder 30 through line 54 to the front end of master cylinder 26 and from the rear end of cylinder 26 through line 53 and the valve 52 to reservoir 51.

In the event a maximum designed load is reached on the scraper unit 11, the pressure of the load acting through the rods 24 will cause fluid to discharge from the rear of cylinder 26 thorough line 53 and, upon opening of pressure relief valve 57, to discharge through line 58 to reservoir 51. At the same time the pressure of the loaded scraper unit will act through rod 28 to force fluid from the rear end of cylinder 30 through line 54 into the front of cylinder 26. The load on the scraper unit required to cause the ripper unit to automatically raise with respect, to the scraper unit will be determined by the setting at which the pressure relief valve 57 will open.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A scrapper with a ripper assembly comprising a wheeled scraper unit including a main tongue for pulling by a prime mover, said scraper unit having an elevated top rail movable up and down with a cutting edge of the scraper a ripper assembly comprising a support bar and spaced apart ripper teeth spaced along the support bar and extending downwardly therefrom said support bar being positioned generally beneath the top rail;

hydraulic cylinder means interconnecting the top rail and the support bar through universal joint means that will raise and lower the ripper assembly relative to the scraper unit, said hydraulic cylinder means comprising a pair of spaced apart hydraulic cylinders, each said cylinder having a rod thereof pivotally connected by a ball journal to the top rail and a housing thereof pivotally connected to the support bar, and means to selectively supply fluid to and to exhaust fluid from the hydraulic cylinders, said means comprising a pump, a fluid storage reservoir, a valve means supplying fluid from the reservoir through the pump to the valve, a hydraulic line having a pressure relief valve therein interconnecting the end of one hydraulic cylinder opposite the rod of the cylinder, a hydraulic line interconnecting the other end of the one hydraulic cylinder with the end of the other hydraulic cylinder opposite the rod of that cylinder, a line with a restrictor therein interconnecting the other end of the other cylinder and the valve, a hydraulic line connecting the valve to the reservoir, and a ripper tongue having one end fixed to the support bar and an opposite end pivotally connected to the main tongue;

a guide arm;

means pivotally connecting one end of said guide arm to the top rail; and means pivotally connecting an opposite end of the guide arm to the support bar at a location offset from directly beneath the one end, whereby the guide arm pivots transversely to the longitudinal axis of the ripper tongue.

* * * * *